United States Patent [19]

Harris

[11] 4,254,983

[45] Mar. 10, 1981

[54] RETRIEVER TOOL

[75] Inventor: Allen E. Harris, Duncan, Okla.

[73] Assignee: Halliburton Company, Duncan, Okla.

[21] Appl. No.: 76,959

[22] Filed: Sep. 19, 1979

[51] Int. Cl.[3] ..... E21B 31/20

[52] U.S. Cl. ..... 294/86.21; 294/86.22; 294/86.25

[58] Field of Search ..... 294/86.1, 86.14, 86.17, 294/86.2–86.25, 86.28–86.34, 93–97

[56] References Cited

U.S. PATENT DOCUMENTS

| | | | |
|---|---|---|---|
| Re. 7,675 | 5/1877 | Fox | 294/86.25 X |
| 1,443,463 | 1/1923 | Edwards | 294/86.22 |
| 1,528,561 | 3/1925 | Nixon | 294/86.25 X |
| 1,823,340 | 9/1931 | Vance | 294/86.28 X |
| 3,095,926 | 7/1963 | Rush | 294/86.25 X |
| 3,698,756 | 10/1972 | Groves | 294/86.25 X |

FOREIGN PATENT DOCUMENTS

| | | | |
|---|---|---|---|
| 19673 | 3/1905 | Austria | 294/86.25 |

*Primary Examiner*—Johnny D. Cherry

*Attorney, Agent, or Firm*—John H. Tregoning; James R. Duzan; Lucian Wayne Beavers

[57] ABSTRACT

A retriever tool includes a central mandrel with a collet sleeve slidably disposed about the mandrel. The collet sleeve includes a plurality of upwardly extending spring fingers, each of the spring fingers having an upper portion including an upward facing catcher shoulder for catching a bridge plug or similar device to be retrieved from a well. Located above the catcher shoulder of the upper portion of the spring finger is an arcuate substantially constant diameter outer surface. Located above the arcuate substantially constant diameter outer surface is an upward facing tapered outer guide surface for guiding the constant diameter outer surface from below into engagement with an inner surface of the bridge plug to be retrieved. Provision is made for releasing the retriever tool from the bridge plug in the event that the bridge plug becomes hung up in the well.

8 Claims, 11 Drawing Figures

RETRIEVER TOOL

The present invention relates generally to retriever tool apparatus for retrieving a device from a well, and more particularly, but not by way of limitation, to a retriever tool apparatus particularly adapted for use in retrieving bridge plugs from producing geothermal steam wells.

A packing device generally referred to as a bridge plug is often used in a well to plug off the inside of the well casing. At some subsequent time it is often necessary to remove the bridge plug from the well. This is generally done by the use of a circular milling tool which mills away the outer edge of the bridge plug so as to free the bridge plug from the well casing.

If the debris from the milled bridge plug is allowed to fall down into the well during the milling operation, that debris often later causes problems by damaging other tools and the like which are located below the bridge plug in the well. This debris might also be blown out of the well at some time later and cause damage to tools and equipment located at the well head.

It is, therefore, desirable to provide a means for catching the bridge plug when it is cut loose by the circular milling tool.

The prior art includes numerous apparatus for so catching the bridge plug, most of which include a central stinger which is passed through a central bore of the bridge plug and which includes a central mandrel with a sliding sleeve disposed thereon having downward extending resilient spring fingers. After passing downward through the bridge plug, the sleeve drops down to an enlarged diameter tapered surface of the mandrel causing expansion of the spring fingers so that they will not pass back upwards through the bridge plug bore.

One particular example of such a prior art retriever tool is manufactured by Bowen Tools, Inc. and is illustrated in their instruction manual No. 5/2710 entitled "Bowen Simplex Packer Retrievers", Seventh Printing, dated June, 1974.

The Bowen type device is a rotary mill type packer retriever that consists of a washover type mill shoe and a centrally located spear that passes through the packer mandrel bore. The spear or center mandrel has a cantilever finger collet sleeve with the expanding fingers pointed in a downward direction. After the stinger passes through the packer bore, the collet sleeve drops down to an enlarging diameter tapered surface or wedge. This causes expansion of the sleeve fingers, thus causing an upset or diameter increase that will no longer pass back through the packer bore, thereby creating a shoulder for the packer mandrel to catch on so that the same may be retrieved. This serves to catch the bridge plug after milling away the outer slips that hold the bridge plug in place within the casing. These components are then retrieved to remove this debris from the well bore.

However, when such a bridge plug is in place within a producing steam well with its vast quantities of high pressure steam rapidly escaping up the well bore, the lifting force of the flowing steam in such a geothermal steam producing well tends to keep the collet fingered sleeve lifted to its uppermost position away from the enlarging diameter tapered surface or wedge. This, therefore, prevents tools of the Bowen type from functioning properly in geothermal steam producing wells. This is because, the collet sleeve depends upon the force of gravity to pull the sleeve downward to engagement with the tapered wedge. The spring fingers on the collet sleeve of the Bowen type packing are not sufficiently expanded to prevent them from passing back through the packer until such time as they are engaged by the tapered wedge. Once the collet sleeve engages the wedge, the spring fingers are urged outwardly so that they may no longer pass back upwards through the packer. In the producing geothermal steam well, however, the forces exerting on the collet sleeve, by the rapidly moving steam passing upward through the well, often overcome the force of gravity, thereby making the Bowen type design unreliable in geothermal steam well applications. For similar reasons, the Bowen type device is sometimes unsuitable for use in deviated holes.

These problems are overcome by the retrieving tool of the present invention which reverses the orientation of the collet sleeve so that the spring fingers are extended upwardly and in which the outside diameter of the flexible collet sleeve fingers is larger than that of the inner bore of the packer through which the retriever tool is to be stabbed. Consequently, initial stab in of the retrieving tool stinger requires compressing the fingers to cause their diameter to contract by applying a downward force. These fingers then expand to their normal larger outside diameter after passing through the packer bore thus creating an interference or catcher shoulder with respect to the packer mandrel when the retriever tool is pulled back upwards.

The spring fingers of the retriever tool of the present invention do not depend on gravity force to cause their expansion, but rather, they are in the expanded condition at any time. Further, an upward facing tapered shoulder is provided on the retriever tool mandrel to back up the expanded spring fingers so that a positively locked catcher shoulder is provided for engagement with the bridge plug.

Additionally, emergency release means is provided for releasing the retriever tool from the bridge plug.

The retriever tool apparatus of the present invention includes a mandrel having a reduced diameter portion with an upward facing tapered outer support surface located below said reduced diameter portion. The central mandrel is slidably received within a collet sleeve which includes a plurality of upwardly extending spring fingers, each of said spring fingers including an upper portion.

Each of the upper portions of the spring fingers includes an upward facing catcher shoulder means for catching the bridge plug to retrieve the same. An arcuate substantially constant diameter outer surface extends upward from said catcher shoulder means, and an upward facing tapered outer guide surface means is located above the constant diameter outer surface for guiding the constant diameter outer surface from below into engagement with an inner bore of the bridge plug.

When the collet spring fingers are in their normal uncompressed position, the catcher shoulders extend to a diameter greater than the diameter of the inner bore of the bridge plug.

The diameter of the arcuate substantially constant diameter outer surfaces of the upper portions of the spring fingers is slightly greater than the diameter of the inner bore of the bridge plug, so that when said substantially constant diameter outer surfaces are pulled into engagement with the inner bore of the bridge plug from below, the outward spring force from the spring fingers is sufficient to hold the collet sleeve in engagement with the inner bore of the bridge plug during relative axial downward motion of the mandrel relative to the collet sleeve.

An emergency release means includes a pin extending from the collet sleeve into a slot of the mandrel, said slot including a peripherally extending slot portion, so that when the pin is moved into engagement with the peripherally extending slot portion, the upper portions of the spring fingers are adjacent the reduced diameter portion of the mandrel so that the spring fingers may be compressed to allow the catcher shoulder means thereof to pass upward through the bridge plug thereby releasing the bridge plug.

Numerous objects, features and advantages of the present invention will be readily apparent to those skilled in the art upon a reading of the following description in conjunction with the accompanying drawings.

Figure 1:
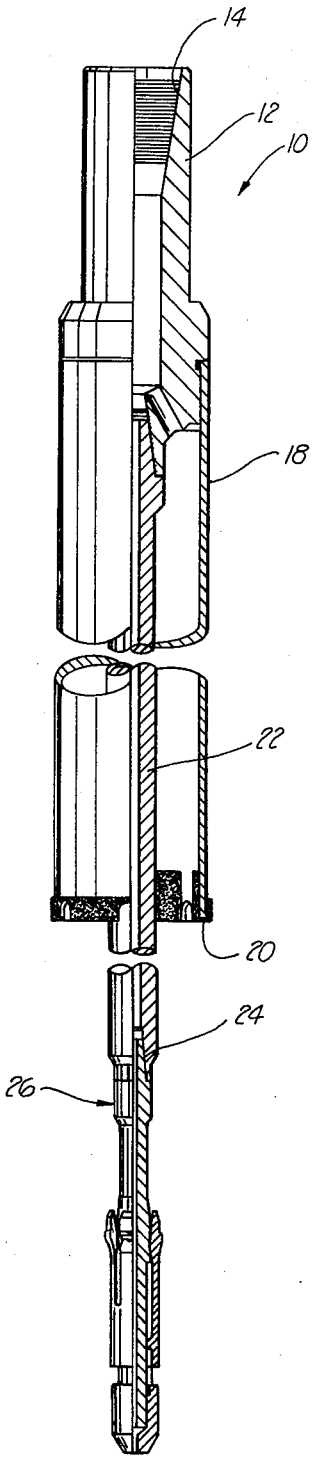
FIG. 1 is an elevation partly sectioned view of a circular milling tool with a centrally located elongated stinger having the retriever tool apparatus of the present invention attached to the lower end thereof.
Figure 4:
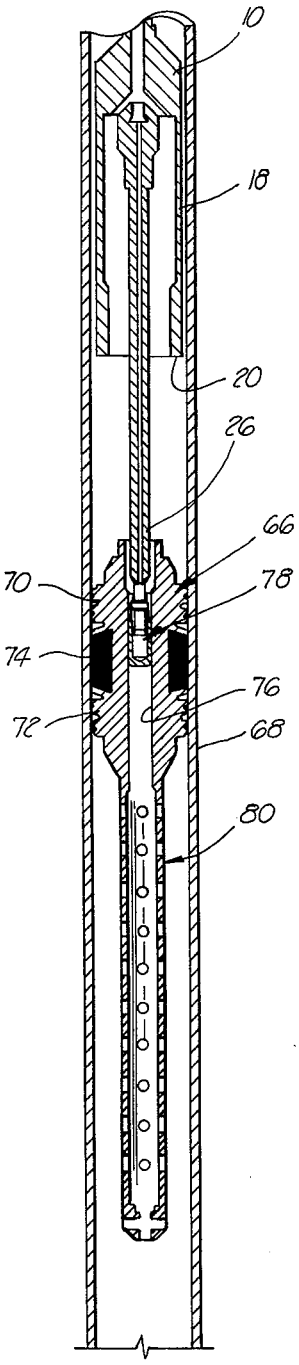
Figure 5:
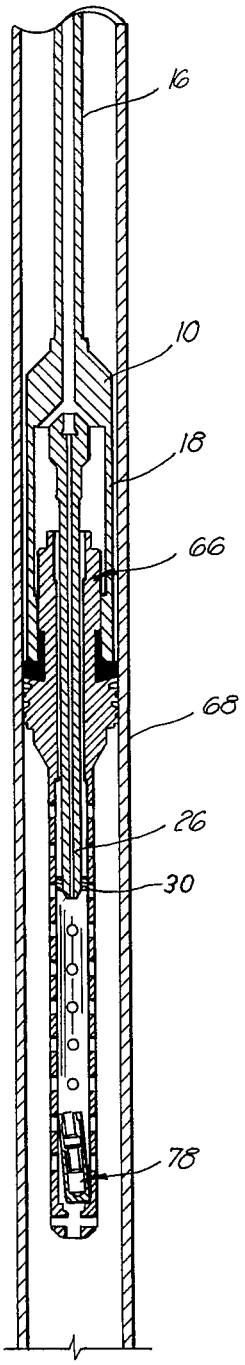
Figure 6:
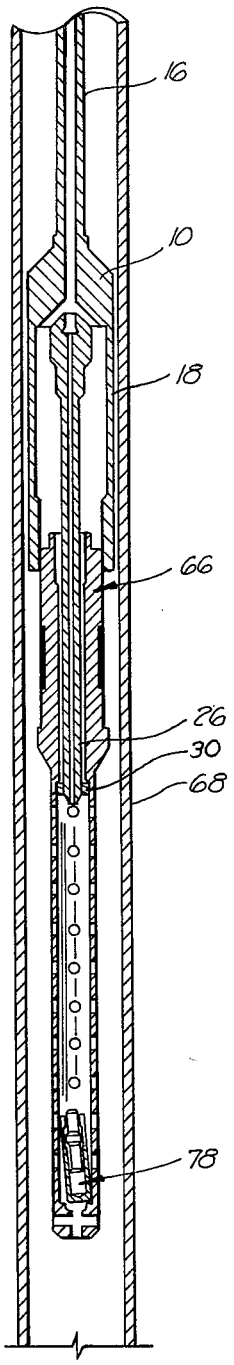

FIGS. 4 through 6 are sequential schematic illustrations of the manner of use of the milling tool with retriever apparatus of FIG. 1, as used to remove a bridge plug from a steam well. FIG. 4 shows the retriever tool initially engaging the bridge plug. FIG. 5 shows the location of the milling tool during the milling operation after the retriever tool has been stabbed through the bridge plug. FIG. 6 shows the retriever tool in retrieving engagement with the bridge plug after the same has been milled over to release it and while it is being pulled from the well.

Figure 7:
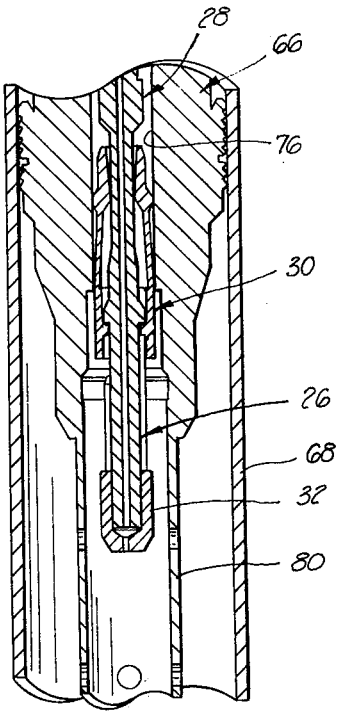

FIG. 7 illustrates the relative orientation between the collet sleeve and the mandrel of the retriever tool apparatus as it is being stabbed through the bridge plug in a downward direction.

Figure 8:
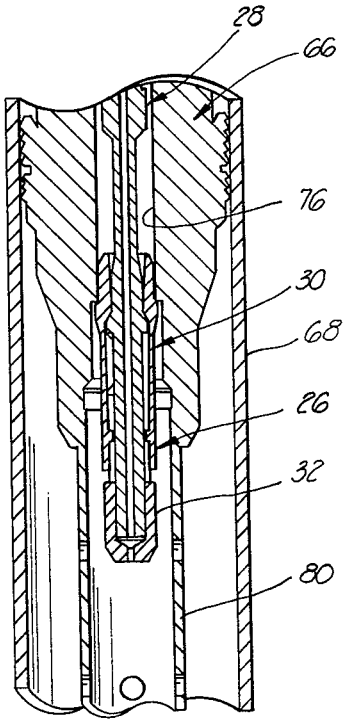

FIG. 8 illustrates the relative orientations of the collet sleeve and the mandrel of the retriever tool apparatus in a position securely engaged with the bridge plug for retrieving the bridge plug.

Figures 9, 10, 11:
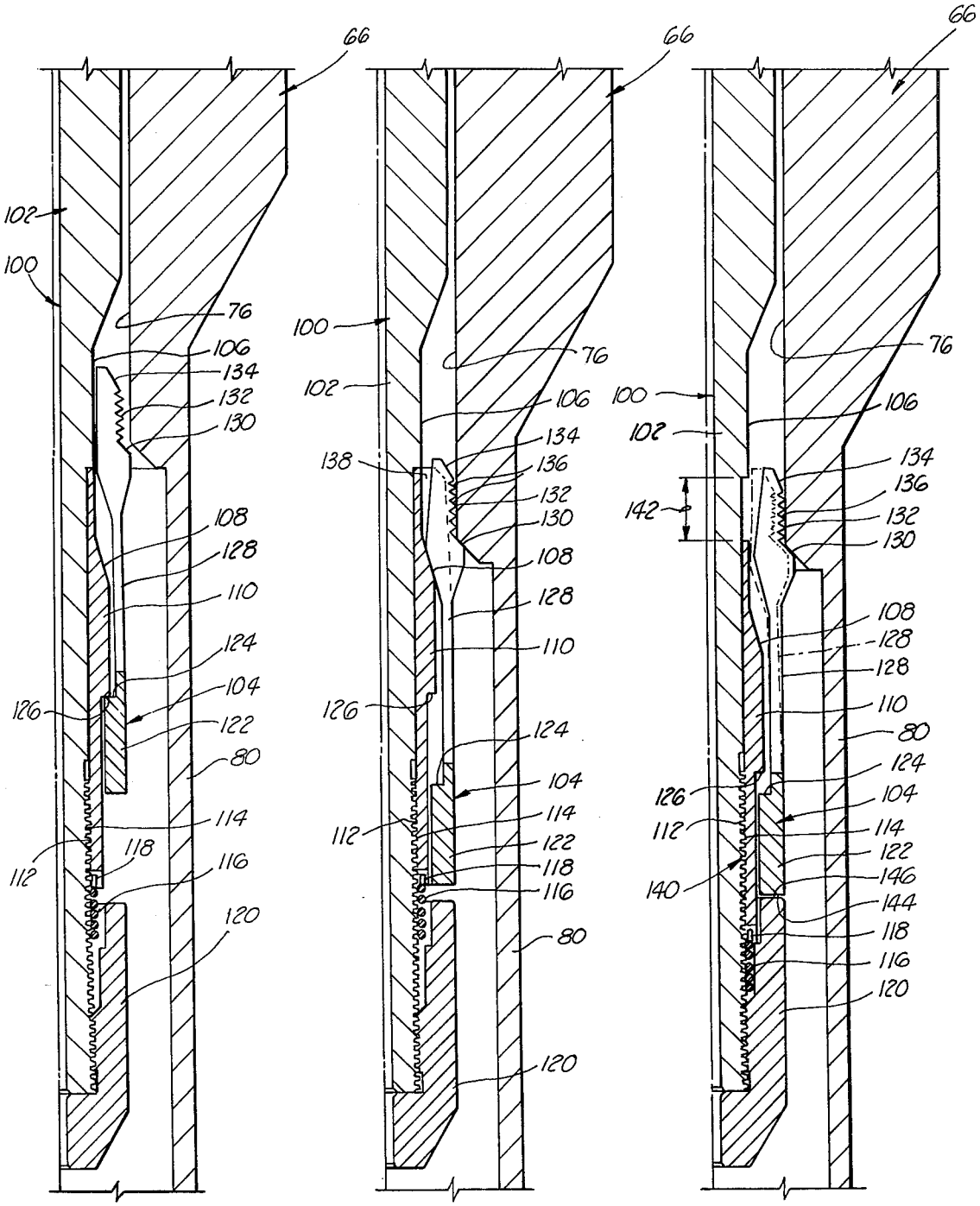

FIG. 9 is an elevation half sectioned view of an alternative embodiment of the retriever apparatus of the present invention illustrating the relative orientation between the collet sleeve and the mandrel as the retriever tool is stabbed through the bridge plug in a downward direction.

FIG. 10 illustrates the relative orientations of the collet sleeve and mandrel of the alternative embodiment of FIG. 9 when the bridge plug is being retrieved.

FIG. 11 illustrates the relative orientations of the collet sleeve and mandrel of the alternative embodiment of FIG. 9 when the collet sleeve is in the emergency release position.

Referring now to the drawings, and particularly to FIG. 1, a rotary milling apparatus with stinger type retriever tool is shown and generally designated by the numeral 10. The milling apparatus 10 includes a bushing portion 12 which is threaded at its upper end 14 for connection to a pipe string 16 (see FIG. 5). Attached to bushing 12 is a circular wash pipe mill 18 having an annular mill face 20 at the lower end thereof. Extending downward from bushing 12 and located concentrically within wash pipe mill 18 is a stinger extension 22. Connected to the lower end of stinger extension 22 at threaded connection 24 is the retriever tool apparatus of the present invention which is generally designated by the numeral 26.

Figure 2:
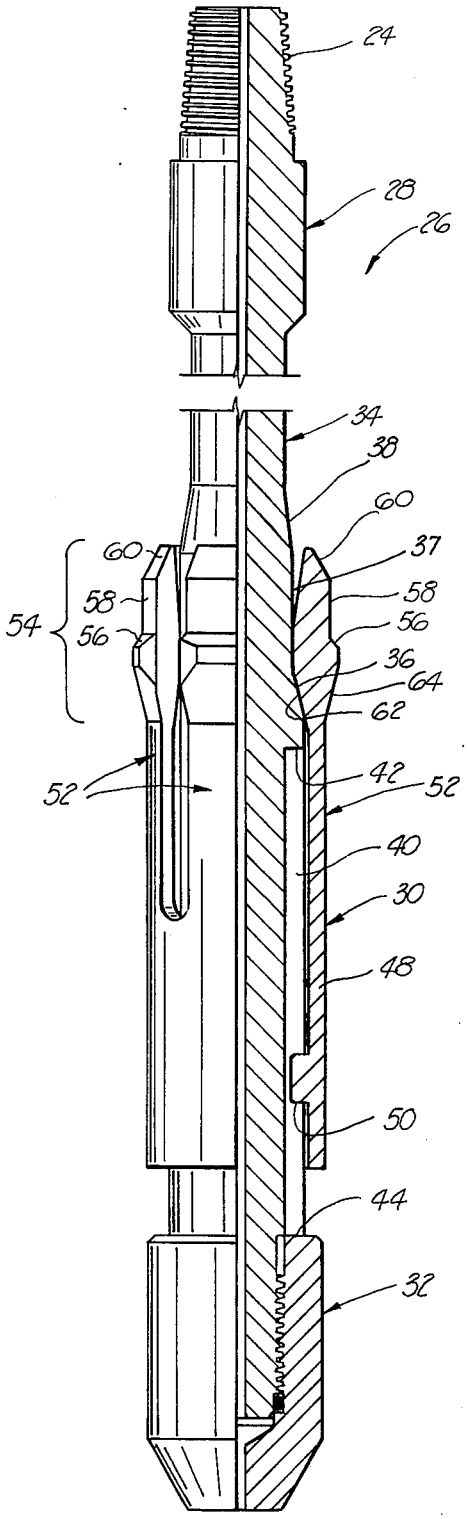
FIG. 2 is an elevation partly sectioned view of the retriever tool apparatus of the present invention.

Referring now to FIG. 2, a detailed elevation partly sectioned view of retriever tool apparatus 26 is thereshown. Retriever tool 26 includes a central mandrel 28, a sliding collet sleeve 30, and a lower nose 32. Nose 32 may include a tungsten carbide particle lower drilling surface as will be understood by those skilled in the art.

Mandrel 28 includes the upper threaded connection 24 at its upper end. The nose 32 is connected to the lower end of mandrel 28. Between the upper and lower ends of mandrel 28 is a reduced diameter portion 34.

Located below reduced diameter portion 34 is an upward facing tapered outer support surface 36 which is connected with reduced diameter portion 34 by flat 37 and tapered transition surface 38.

Disposed in mandrel 28 below support surface 36 are two longitudinally extending groove means 40 (only one of which is seen in FIG. 2). The construction of groove means 40 is best illustrated in FIG. 3 which is an elevational lay out of the groove means 40.

Figure 3:
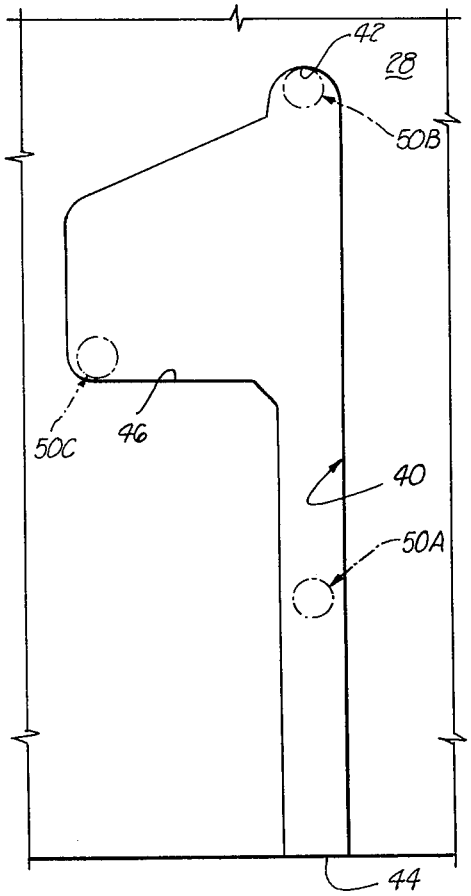
FIG. 3 is an elevation view of the groove of the mandrel of the retriever tool of FIG. 2.

As seen in FIG. 3, groove means 40 comprises a longitudinally extending groove having a closed upper end 42 and an open lower end 44. As is seen in FIG. 2, the open lower end 44 is closed off by nose 32 when the retriever tool apparatus 26 is assembled. Extending from the longitudinal portion of groove means 40 is a transverse or peripherally extending groove portion 46.

The collet sleeve 30 includes a lower cylindrical portion 48 having a pair of pins 50 extending inward into sliding engagement with the grooves 40 of mandrel 28.

Extending upward from cylindrical portion 48 are a plurality of collet spring fingers 52. Each of the spring fingers 52 includes an upper portion 54. Each of the upper portions 54 includes an upward facing catcher shoulder means 56 for catching a device to be retrieved from the well, namely the bridge plug 66 as illustrated in FIGS. 4 through 6.

Extending upward from catcher shoulder means 56 is an arcuate substantially constant diameter outer surface 58. Extending upward from outer surface 58 is an upward facing tapered outer guide surface means 60 for guiding said constant diameter outer surface 58 from below into engagement with an inner surface of the device to be retrieved, such as inner bore 76 of bridge plug 66.

The upper portions 54 of spring fingers 52 each also include a downward facing radially inner surface 62 for engagement with support surface 36 of mandrel 28 to limit downward movement of collet sleeve 30 relative to mandrel 28 and to prevent radially inward movement of the spring fingers 52 when the surfaces 36 and 62 are in engagement, so that catcher shoulder means 56 may be retained in secure engagement with the device to be retrieved from the well during the retrieval thereof. Tapered surfaces 36 and 62 are both tapered at angles of approximately 30° relative to the longitudinal axis of mandrel 28.

Also included on each upper portion 54 is a radially outer downward facing tapered shoulder 64 which aids in compressing the spring fingers 52 when the retriever tool apparatus 26 is being stabbed into the bridge plug 66 or other device to be retrieved from the well.

Referring now to FIGS. 4, 5 and 6, the manner of operation of the milling apparatus 10 with retriever tool apparatus 26 is schematically illustrated.

FIG. 4 shows a bridge plug 66, which may generally be referred to as a device to be retrieved from the well, located within a well casing 68.

The bridge plug 66 generally includes a set of upper slips 70, a set of lower slips 72, and an elastomeric packing portion 74 located between the upper and lower slips 70 and 72.

Located within an inner bore or inner surface 76 of bridge plug 66 is a pressure equalizing valve 78. Extending from the lower end of bridge plug 66 is a junk catcher tube 80.

The manner of operation of the milling apparatus 10 with retriever tool apparatus 26, in combination with a bridge plug 66 and a producing geothermal steam well defined by the casing 68, is as follows.

Prior to engagement of the lower nose 32 of retriever tool 26 with equalizing valve 78, the equalizing valve isolates the portions of the well above and below bridge plug 66 so that the steam pressure below bridge plug 66 is substantially greater than that above bridge plug 66. When the nose 32 of retriever tool 26 engages the valve 78, the valve 78 is opened thereby allowing steam to escape through the bridge plug 66 so as to equalize the pressure above and below the bridge plug 66 prior to the beginning of the milling operation.

The pipe string 16 is lowered until the catcher apparatus 26 has stabbed through the inner bore 76 of bridge plug 66 thereby pushing equalizer valve 78 out of the bore 76 and into the junk catcher tube 80 as shown in FIGS. 5 and 6.

The collet sleeve 30 of retriever tool 26 passes entirely through inner bore 76 and is located inside the junk catcher tube 80 during the milling operation as illustrated in FIG. 5. In FIG. 5 the annular mill face 20 has already milled away the upper slip 70 and approximately one-half of the elastomeric packer material 74.

Once the upper slip 70 has been milled away the bridge plug 66 is then free to be retrieved from the casing 68 as elastomeric packing portion 74 is no longer set under compression by slips 70 and 72. However, it is desirable to mill away both upper and lower slips 70 and 72, if possible, in order to remove as much debris as possible from casing 68 and minimize the possibility of hanging up tools in the casing. Retrieval is by lifting the pipe string 16 so as to catch the lower end of bridge plug 66 on the catcher shoulder means 56 of the retriever tool 26 so that the entire apparatus may be retrieved from the well.

The relative orientations of the collet sleeve 30 and the mandrel 28 of retriever tool 26 during these operations are best illustrated in FIGS. 7 and 8, with additional reference being made to FIG. 3 to illustrate the locations of the pin 50 within groove 40 during these operations.

Before the retriever tool 26 is stabbed into the bridge plug 66 from above, the force of gravity acting upon collet sleeve 30 generally causes collet sleeve 30 to be in the position illustrated in FIG. 2 relative to the mandrel 28, with downward facing tapered surfaces 62 of upper portions 54 of collet spring fingers 52 being in engagement with upper tapered support surface 36 of mandrel 28. With the mandrel 28 and the collet sleeve 30 in the relative orientation illustrated in FIG. 2, the pin 50 is generally in the location illustrated in phantom lines as 50A in FIG. 3.

As the retriever tool 26 is stabbed into bridge plug 66, the engagement of collet sleeve 30 with inner bore 76 of bridge plug 66 causes collet sleeve 30 to move upwards on mandrel 28 until pin 50 engages the upper end 42 of groove 40 as illustrated in phantom lines in FIG. 3 by the numeral 50B.

The engagement of pin 50 with upper end 42 of groove 40 as shown at 50B may be described as a limit means for limiting upward movement of collet sleeve 30 relative to mandrel 28 so that when collet sleeve 30 is in a first upper position relative to mandrel 28 the upper portions 54 of spring fingers 52 are adjacent the reduced diameter portion 34 of mandrel 28 so that the spring fingers 52 may be urged resiliently radially inward to allow catcher shoulder means 56 to move downward past bridge plug 66. This is the orientation illustrated in FIG. 7, showing the retriever tool 26 partially stabbed through the bore 76 of bridge plug 66.

After the retriever tool 26 is stabbed through bridge plug 66, the collet sleeve 30 is generally free to fall downward relative to mandrel 28 due to the force of gravity so that the pin 50 is generally once again in the position illustrated at 50A in FIG. 3. Throughout the milling operation illustrated in FIG. 5, the collet sleeve 30 and the mandrel 28 will generally be in the orientation shown in FIG. 2.

After the milling operation is completed, the pipe string 16 is raised, lifting the retriever tool 26. The upward facing tapered guide surfaces 60 of the upper portions 54 of spring fingers 52 first engage inner bore 76 of bridge plug 66 and guide the arcuate relatively constant diameter outer surfaces 58 into engagement with inner bore 76. The upward facing tapered support surface 36 of mandrel 28 moves into engagement with the downward facing tapered radially inner surfaces 62 of upper portions 54 of spring fingers 52 to support said upper portions 54 against radially inward movement so that when said collet sleeve 30 is in a second lower position as illustrated in FIG. 8, relative to mandrel 28, the spring fingers 52 are positively locked to prevent inward movement thereof and to hold catcher shoulder means 56 in a position for securely engaging the bridge plug 66 so that the bridge plug 66 may be removed from the well casing 68.

The relative position between the collet sleeve 30 and the mandrel 28 illustrated in FIG. 8 is the same as that illustrated in FIG. 2, so the pin 50 is generally in the position illustrated at 50A in FIG. 3.

During the normal operation of the retriever tool 26, the procedure just described completes the job. There are, however, instances in which the milling operation may not be completely successful, or the bridge plug 66 might somehow hang up within the well casing 68, so that it is desirable to release the retriever tool 26 from the bridge plug 66. This releasing operation may be accomplished in the following manner.

The releasing operation will be described beginning with the collet sleeve 30 being located in junk catcher tube 80 below bridge plug 66 so that the collet sleeve 30 is not in engagement with inner bore 76 of bridge plug 66.

First the pipe string 16 is lifted until the collet sleeve 30 sticks into the bridge plug 66 with arcuate relatively constant diameter outer surfaces 58 being in engagement with inner bore 76 of bridge plug 66. The outer diameter of arcuate substantially constant diameter outer surfaces 58 is slightly larger than the inner diameter of inner bore 76, so that the spring fingers 54 are compressed inwardly sufficient to provide a radially outward directed force from the spring fingers sufficient to hold the collet sleeve 30 in engagement with inner bore 76 of bridge plug 66. At this point, the various components are in the orientation illustrated in FIG. 8.

Then, the pipe string 16 is lowered a short distance, approximately 2 or 3 inches, and the pipe string 16 is rotated one quarter turn, i.e. 90°, counterclockwise so that pin 50 is moved into the tranverse groove extension 46 of groove means 40 to the position illustrated in phantom lines as 50C in FIG. 3. When pin 50 is in position 50C, the sleeve 30 may be described as being in a release position, with the spring fingers 52 being held in a release position with upper portions 54 adjacent reduced diameter portion 34 of mandrel 28.

The dimensions of mandrel 28 and collet sleeve 30 are such that when the pin 50 is in the position illustrated as 50C in FIG. 3, the upper portions 54 of spring fingers 52 are in a position adjacent the reduced diameter portion 34 of mandrel 28 so that the spring fingers 52 may be compressed inwardly.

With the pin 50 in the position illustrated in 50C in FIG. 3, the pipe string 16 is then pulled upwardly. The spring fingers 52 are compressed radially inward by engagement with inner bore 76 of bridge plug 66 so that the catcher shoulder means 56 are moved sufficiently inwardly to pass upward through inner bore 76 thereby releasing retriever tool 26 from bridge plug 66.

After releasing the bridge plug 66, retriever tool 26 may be reset by merely rotating the pipe string 16 clockwise. It may also be reset by setting down on pipe string 16 so that the sloped upper ledge of peripheral groove portion 46 directs the pin 50 back into position 50A. The retriever tool 26 may then be re-engaged with bridge plug 66.

Referring now to FIGS. 9, 10 and 11, an alternative embodiment of the retriever tool of the present invention is shown and generally designated by the numeral 100.

FIG. 9 is an elevation half section view to the right side of the center line of retriever tool 100 showing the retriever tool 100 being stabbed into the bridge plug 66 in a manner similar to that previously illustrated in FIG. 7 for the retriever tool 26.

The retriever tool 100 includes a central mandrel 102 and a collet sleeve 104.

The mandrel 102 includes a radially outer reduced diameter portion 106 below which is located an upward facing tapered radially outer support surface 108. The support surface 108 is defined by a screw jack sleeve 110.

The screw jack sleeve 110 includes a screw jack threaded portion 112 on a lower radially inner cylindrical surface thereof. The screw jack threads 112 of screw jack sleeve 110 engage radially outward facing screw jack threads 114 of mandrel 100, so that the screw jack sleeve 110 may be moved longitudinally relative to mandrel 100 by rotating mandrel 100 relative to screw jack sleeve 110.

A rotary clutch spring 116 has an upper end 118 engaging the lower end of screw jack sleeve 110. The coils of clutch spring 116 engage screw jack threads 114 below screw jack sleeve 110 so that mandrel 100 is permitted to rotate counterclockwise as viewed from above, relative to screw jack sleeve 110 to move the screw jack sleeve 110 downward to a position shown in FIG. 11 due to the lefthand threads 112 and 114. The clutch spring, however, prevents mandrel 100 from rotating clockwise as viewed from above, relative to screw jack sleeve 110.

A nose portion 120 is connected to the lower end of mandrel 100.

Collet sleeve 104 includes a lower cylindrical collet sleeve portion 122 which includes an upward facing radially inward annular shoulder 124. As shown in FIG. 9, the upward facing shoulder 124 engages a lower facing shoulder 126 of screw jack sleeve 110 when the retriever tool 100 is being stabbed in through bridge plug 66 from above.

Extending upward from lower cylindrical portion 122 of collet sleeve 104 are a plurality of collet spring fingers 128. Each of the collect spring fingers 128 includes an upper portion having an upward facing catcher shoulder means 130 and arcuate substantially constant diameter outer surface 132 and an upward facing tapered outer guide surface 134.

The collet sleeve 104 and the mandrel 102 with its reduced diameter portion 106 and upward facing support surface 108 just described operated in substantially the same manner as the similar components of the retriever tool 26 of FIGS. 1 through 8 during the stabbing in and retrieving operation. The engagement of shoulders 124 and 126 is the functional equivalent of the engagement of pin 50 with upper end 42 of longitudinal groove 40 of the embodiment of FIGS. 1 through 8.

Referring now to FIG. 10, the apparatus of FIG. 9 is shown in the retrieving position, analagous to the position illustrated in FIG. 8 with regard to retriever tool 26.

A couple of additional features are shown in FIG. 10. The arcuate substantially constant outer surface 132 of retriever tool 100 is slightly modified from the analagous surface 58 of retriever tool 26 in that the surface 132 includes a plurality of peripherally extending grooves 136 which assist the spring fingers 52 in gripping the inner bore surface 76 of bridge plug 66. Grooves 136 are formed by threading outer surface 132.

Also, the screw jack sleeve 110 includes radially outward projecting flanges 138 which prevent rotation of collet sleeve 104 relative to screw jack sleeve 110.

The primary difference between the retriever tool 100 of FIGS. 9–11 and the retriever tool 26 of FIGS. 1–8 is the emergency release mechanism.

The emergency release of the retriever tool 100 is provided by the screw jack means 140 comprising screw jack threads 112 and 114.

The screw jack means 140 may be described as being connected between mandrel 102 and support surface 108 for moving support surface 108 downward relative to mandrel 102 from a normal operating position, as illustrated in FIGS. 9 and 10, to a release position as illustrated in FIG. 11.

When mandrel 102 is rotated relative to screw jack sleeve 110, the screw jack sleeve 110 is moved downward relative to mandrel 102 by the distance designated 142 in FIG. 11. This effectively lengthens the reduced diameter portion 106 by the distance 142.

Downward movement of collet sleeve 104 relative to mandrel 102 is limited by the engagement of a lower annular surface 144 of collet sleeve 104 with an upward facing stop shoulder means 146 extending radially outward from mandrel 102 by means of the nose 120. When the support surface 108 is in the release position illustrated in FIG. 11, and when collet sleeve 104 is in engagement with stop shoulder means 146, the upper portions of the collet spring fingers 128 are held in a position adjacent reduced diameter portion 106, as extended by the distance 142, so that when the mandrel 102 is pulled upward, the spring fingers 128 may be compressed radially inward to the position shown in phantom lines in FIG. 11 thereby allowing the retriever tool 100 to release bridge plug 66.

Stop shoulder means 146 may be described as a release limit means for limiting downward movement of collet sleeve 104 relative to mandrel 102 when support surface 108 is in its release position as illustrated in FIG. 11, so that the upper portions of spring fingers 128 are prevented from engaging support surface 108.

Thus it is seen that the retriever tool apparatus of the present invention achieves the ends and advantages mentioned as well as those inherent therein. While present preferred embodiments of the present invention have been illustrated and described for the purpose of this disclosure, numerous changes in the construction and arrangement of parts can be made by those skilled in the art, which changes are encompassed within the spirit of the invention as defined by the appended claims.

What is claimed is:

1. A method of retrieving a device from a well, and releasing said device during the retrieval thereof, said method comprising the steps of:

stabbing a retriever tool downward through a central bore of said device, said retriever tool including a mandrel having a reduced diameter portion with an upward facing support surface located therebeneath and including a sleeve slidably disposed on said mandrel, said sleeve including a plurality of upwardly extending spring fingers, the upper portion of each spring finger including:

a downward facing tapered outer surface means for compressing said spring finger radially inward when said retriever tool is stabbed downward through said central bore of said device to be retrieved;

an upward facing catching shoulder means, located above said downward facing tapered outer surface means, for engaging a downward facing surface of said device to be retrieved after said retriever tool is stabbed downward through said central bore of said device;

an arcuate substantially constant diameter outer surface extending upward from said catching shoulder means for engaging said central bore of said device when said upward facing catching shoulder means is engaged with said downward facing surface of said device; and an upward facing tapered outer surface means, located above said substantially constant diameter outer surface, for guiding said substantially constant diameter outer surface from below into engagement with said central bore of said device;

said stabbing including a step of engaging said downward facing outer surface means of each of said spring fingers with said central bore as said retriever tool is stabbed through said device thereby compressing said spring fingers radially inward so that said catching shoulder means may pass downward through said central bore of said device;

lifting said retriever tool to engage said catching shoulder means with said device, to engage said arcuate substantially constant diameter outer surfaces with said central bore of said device, and to engage said support surface of said mandrel with said spring fingers to prevent inward contraction thereof;

stopping said lifting step when it is desired to release said device;

moving said support surface of said mandrel downward relative to said spring fingers while said arcuate substantially constant diameter outer surfaces remain engaged with said central bore of said device;

holding said upper portions of said spring fingers adjacent said reduced diameter portion of said mandrel; and lifting said retriever tool upward through said central bore of said device, said spring fingers being compressed inward so as to pass through said central bore and release said device.

2. A retriever tool apparatus comprising:

a central mandrel; and a sleeve within which said central mandrel is slidably received, said sleeve including a plurality of upward extending spring fingers, each of said spring fingers including an upper portion, each of said upper portions including:

a downward facing tapered outer surface means for compressing said spring fingers radially inward when said retriever tool apparatus is stabbed downward through an inner bore of a device to be retrieved;

an upward facing catching shoulder means, located above said downward facing tapered outer surface means, for engaging a downward facing surface of said device to be retrieved after said retriever tool apparatus is stabbed downward through said inner bore of said device;

an arcuate substantially constant diameter outer surface extending upward from said catching shoulder means for engaging said inner bore of said device when said upward facing shoulder means is engaged with said downward facing surface of said device; and an upward facing tapered outer surface means, located above said substantially constant diameter outer surface, for guiding said substantially constant diameter outer surface from below into engagement with said inner bore of said device.

3. The apparatus of claim 2, wherein:

said central mandrel includes a reduced diameter portion and an upward facing tapered outer support surface located below said reduced diameter portion; and said upper portions of said spring fingers each include a downward facing tapered radially inner surface constructed for engagement with said support surface of said central mandrel to prevent radially inward movement of said spring fingers when said downward facing tapered radially inner surface is engaged with said support surface, so that said catcher shoulder means is retained in secure engagement with said device to be retrieved during the retrieval thereof.

4. The apparatus of claim 3, further comprising:

screw jack means connected between said mandrel and said support surface of said mandrel, for moving said support surface downward relative to said mandrel from an operating position to a release position.

5. The apparatus of claim 2, wherein:

said mandrel includes a longitudinal groove having a transverse groove portion extending therefrom;

said sleeve includes a radially inward extending pin slidably received in said groove, said mandrel and sleeve being so arranged and constructed that an upper position of said sleeve relative to said mandrel is defined by engagement of said pin with an upper end of said longitudinal groove, said upper portions of said spring fingers being located adjacent a reduced diameter portion of said mandrel when said sleeve is in its upper position thereby allowing said spring fingers to compress radially inward and pass downward through said device to be retrieved.

6. The apparatus of claim 5, wherein:

an uncompressed diameter of said arcuate substantially constant diameter outer surfaces of said upper portions of said spring fingers is greater than an inner diameter of said inner bore of said device to be retrieved, so that once said constant diameter outer surfaces are pulled from below into engagement with said inner bore of said device to be retrieved a resilient force from said spring fingers is then sufficient to hold said sleeve in engagement with said inner bore of said device upon subsequent downward movement of said mandrel relative to said sleeve; and said mandrel and sleeve are so arranged and constructed that when said pin is located in said transverse groove portion said upper portions of said spring fingers are held adjacent said reduced diameter portion of said mandrel so that said device to be retrieved may be released by pulling said retriever tool apparatus upward through said device.

7. A retriever tool apparatus comprising:

a central mandrel including a reduced diameter portion and an upward facing tapered outer support surface located below said reduced diameter portion;

a sleeve within which said central mandrel is slidably received, said sleeve including a plurality of upward extending spring fingers, each of said spring fingers including an upper portion, each of said upper portions including:

an upward facing catching shoulder means for catching a device to be retrieved;

an arcuate substantially constant diameter outer surface extending upward from said catching shoulder means;

an upward facing tapered outer surface means located above said substantially constant diameter outer surface, for guiding said substantially constant diameter outer surface from below into engagement with an inner surface of said device to be retrieved; and a downward facing tapered radially inner surface constructed for engagement with said support surface of said central mandrel to prevent radially inward movement of said spring fingers when said downward facing tapered radially inner surface is engaged with said support surface, so that said catching shoulder means is retained in secure engagement with said device to be retrieved during the retrieval thereof;

a screw jack means connected between said mandrel and said support surface of said mandrel, for moving said support surface downward relative to said mandrel from an operating position to a release position; and an upward facing stop means extending radially outward from said mandrel below said sleeve for limiting downward movement of said sleeve relative to said mandrel when said support surface of said mandrel is in its said release position, so that said downward facing radial inner surfaces of said upper portions of said spring fingers are prevented from engaging said support surface of said mandrel when said support surface is in its said release position.

8. A retriever tool apparatus comprising:

a mandrel including a reduced diameter portion;

a sleeve slidingly engaging said mandrel, said sleeve including a plurality of upwardly extending spring fingers;

catcher means, extending from upper portions of said spring fingers, for engaging a device to be retrieved from a well;

limit means for limiting upward movement of said sleeve relative to said mandrel, so that when said sleeve is in a first upper position relative to said mandrel said upper portions of said spring fingers are adjacent said reduced diameter portion of said mandrel so that said spring fingers may be urged resiliently inward to allow said catcher means to move past said device to be retrieved;

support means for limiting downward movement of said sleeve relative to said mandrel and for supporting said upper portions of said spring fingers against radially inward movement, so that when said sleeve is in a second lower position relative to said mandrel with said support means engaging said spring fingers, said spring fingers are supported against radially inward movement thereof so that said catcher means is held in a position for securely engaging said device to be retrieved from said well; and release means for moving and holding said spring fingers out of engagement with said support means, said sleeve being held in a release position with said upper portions of said spring fingers adjacent said reduced diameter portion of said mandrel, so that said upper portions of said spring fingers may be urged resiliently inward to release said device from said secure engagement with said catcher means; said release means including:

screw jack means, connected between said mandrel and said support means, for moving said support means downward relative to said mandrel from an operating position to a release position; and release limit means for limiting downward movement of said sleeve relative to said mandrel when said support means is in its said release position, so that said upper portions of said spring fingers are prevented from engaging said support means.

* * * * *